United States Patent [19]

de Bosredon

[11] 4,222,550

[45] Sep. 16, 1980

[54] MOBILE WINCH

[76] Inventor: Pierre de Bosredon, 17 rue Millet, 24 Bergerac, France

[21] Appl. No.: 821,149

[22] Filed: Aug. 2, 1977

[30] Foreign Application Priority Data

Aug. 3, 1976 [FR] France ..... 76 23773

[51] Int. Cl.[2] ..... A63B 61/04

[52] U.S. Cl. ..... 254/223; 242/117; 254/213

[58] Field of Search ..... 254/161, 164, 167; 105/477, 469; 248/503; 24/686 D; 242/117; 280/179 R, 179 A

[56] References Cited

U.S. PATENT DOCUMENTS

| | | | |
|---|---|---|---|
| 426,608 | 4/1890 | Thomas | 242/117 |
| 449,207 | 3/1891 | Cunningham et al. | 242/117 |
| 1,001,547 | 8/1911 | McMillen | 254/164 |
| 1,536,383 | 5/1925 | French | 242/117 |
| 1,570,607 | 1/1926 | Bashline | 254/164 |
| 1,828,290 | 10/1931 | Moon | 254/161 |
| 3,240,473 | 3/1966 | Coffey et al. | 254/161 |
| 3,749,366 | 7/1973 | Brucker | 254/164 |
| 3,910,558 | 10/1975 | Brucker et al. | 254/164 |

*Primary Examiner*—Robert J. Spar
*Assistant Examiner*—Kenneth Noland

[57] ABSTRACT

A mobile winch for the lashing of loads, comprising a base, a drum rotatably mounted on the base, and a drive for rotating the drum relative to the base, the drum being provided with a first opening in the peripheral surface of the drum communicating with a second opening in one end of the drum, whereby the free end of a lashing cable or rope can be passed respectively through the first and second openings for winching.

5 Claims, 5 Drawing Figures

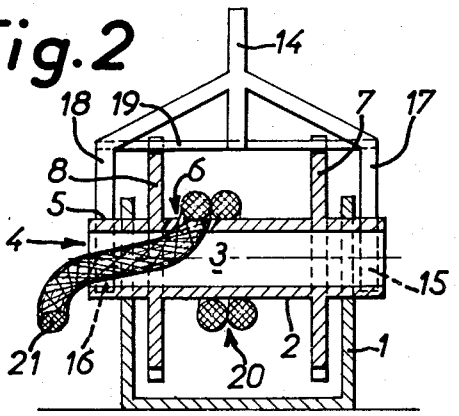
Fig.2
14
17
7
15
1
2
20
3
6
19
18
8
5
16
4
21
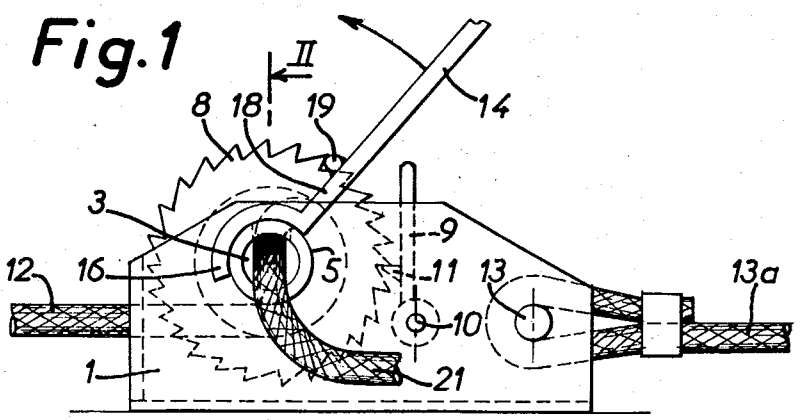
Fig.1
14
13a
13
9
11
10
21
19
II
18
8
5
3
16
1
12
II
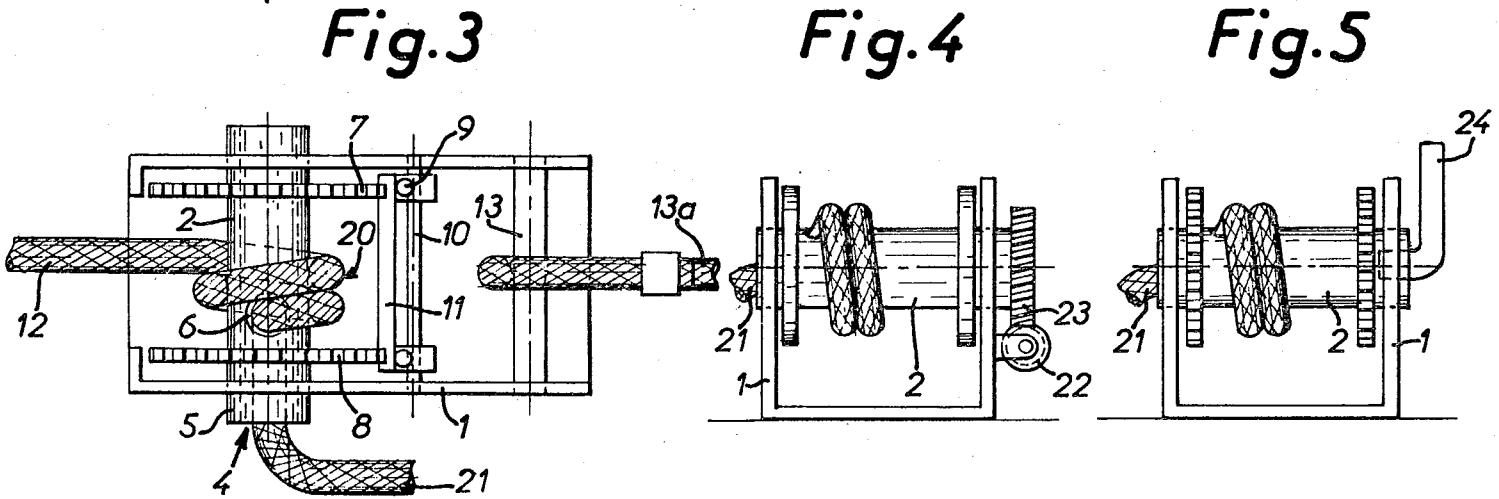
Fig.5
24
1
2
21
Fig.4
23
22
2
21
1
Fig.3
13a
13
9
10
11
1
21
7
20
8
2
6
5
4
12

MOBILE WINCH

The present invention relates to a mobile winch for the lashing of loads which permits the lashing of a load particularly on a vehicle without fixed equipment by means of a simple cable or rope of a sufficient but not specifically determined length.

Lashing winches intended to secure loads are generally fixed on the chassis of vehicles. Some winches are however mobile and therefore utilise a securing strap. The first mentioned system has the inconvenience of a fixed installation which may be cumbersome and will not always pull the lashing cable or rope in the most favourable direction. The second mentioned system requires the provision of a securing strap with the advantages but also the serious inconveniences which this implies.

An object of the present invention is to allow for the lashing of a load, particularly on a vehicle, to be effected by a continuous cable or rope without being constrained by the extreme length thereof, being obliged to use a winching drum of great size, or being constrained by fixed installations.

The present invention accordingly provides a mobile winch for the lashing of loads comprising a base, a drum rotatably mounted on the base, and means for rotating the drum relative to the base, the drum being provided with a first opening in the peripheral surface of the drum communicating with a second opening in one end of the drum, whereby the free end of a lashing cable or rope can be passed respectively through said first and second openings for winching.

The invention will now be more particularly described, by way of example only, with reference to the accompanying drawings, in which:

FIG. 1 is a side view of a mobile winch in accordance with the invention;

FIG. 2 is a cross-sectional end view of the winch of FIG. 1;

FIG. 3 is a top view of the winch of FIG. 1 with a winding lever removed;

FIG. 4 is an end view of a modified form of winch;

FIG. 5 is an end view of a further modified form of winch.

The winch shown in FIGS. 1 to 3 comprises a channel-shaped base 1 whose sides rotatably support respective ends of a drum 2 in the form of an open-ended tube having a bore 3. The drum 2 has a first opening 6 provided in the peripheral surface thereof communicating with an opening 4 at one end 5 of the drum. The drum is provided with a pair of spaced flanges constituted by ratchet wheels 7 and 8. Behind the drum a detent pawl 9 is rotatably mounted on an axle 10 whose ends are received in respective bores on each side of the base 1. The detent pawl 9 is provided with a cross-bar 11 engageable in the teeth of the ratchet wheels 7 and 8 of the drum. The detent pawl 9 is continuously urged by a spring which is not shown in order to maintain the cross bar 11 in engagement with the teeth of the ratchet wheels, disengagement being effected by manual displacement of the detent pawl 9 against the spring force.

The above-described mobile winch can accommodate a certain length of lashing rope or cable 12. A transverse bar 13 mounted on the base 1 parallel to the axis of the drum 2 and in a plane parallel to the bottom of the channel of the base and tangential to the peripheral surface of the drum may be connected by a cable 13*a* or by other means to a fixed support on the chassis of the vehicle concerned. The free end of the winching rope or cable 12, intended for example to lash a load on a vehicle in a manner not shown, is introduced through the first opening 6 in the peripheral surface of the drum 2 and passes out through the second opening 4 in the end of the drum along the axis thereof.

A forked winching lever 14 is formed with curved ends 15 and 16 on its arms 17 and 18 respectively for engagement with the drum 2, and carries a cross-bar 19 for engagement with the teeth of the ratchet wheels 7 and 8. The operator can rotate the drum 2 by means of intermittent movements of the lever 14, the drum being restrained from reverse rotation by the detent pawl 9.

The rotation of the drum 2 effects the winching of the cable 12 into a roll 20. In view of the fact that the free end 21 of the cable extends axially of the drum 2 from the opening 4 thereof, only the working of the cable is rolled up on the drum, in contrast to conventional winches where both the working parts and unused parts of the cable are rolled up side by side. The winch according to the invention therefore allows, in the same volume, the rolling up of twice the length of working part of the cable, or for a comparable length of rolled up cable, to reduce the volume of the mechanism by 50% as compared with conventional winches.

Another advantage of the system is allow the use of a standard length of cable by passing the free end thereof through the respective openings in the drum and adjusting the working length as appropriate for lashing.

The release of the lashing can equally be effected by means of the lever 14 and manual actuation of the detent pawl 9.

The same result can be obtained by means of a worm 22 in driving engagement with a gear wheel 23 mounted on one end of the drum 2 as shown in FIG 4, or by means of a lever 24 whose end is positively engageable in the end of the drum remote from the opening 4 through which the free end 21 of the cable extends as shown in FIG. 5.

It is clear that the invention may be subject to numerous modifications of the particular embodiments described, particularly in the form and disposition of the base and the drum, provided with one or two wheels, ratchet toothed or not, and in the means for driving the drum. When constructed with a relatively small size, the winch can constitute a means of tightening cables which is extremely light and of great practicality.

I claim:

1. A mobile winch for the lashing of loads with a rope or cable, comprising a base, a drum in the form of an open-ended tube rotatably mounted on the base, and means for rotating the drum relative to the base, the drum being provided with a first opening in the peripheral surface of the drum slightly larger in diameter than the lashing rope or cable and communicating with an axial second opening in one end of the drum larger in diameter than the lashing rope or cable, said drum carrying at least one coaxial ratchet wheel cooperating with a detent pawl on the base, said base being formed with a bar extending parallel to the drum axis for attachment of a cable or rope to connect the winch to a fixed support, said base being of channel-shaped construction with the drum extending across the channel and rotatably supported at each end in a respective side at the channel, whereby the free end of a lashing cable or rope can be freely passed respectively through said first and second openings and outside the base so that the free hanging end of the cable or rope can be gripped and pulled to pretension the lashing cable or rope into gripping engagement with the edge of the first opening before the drum is rotated for final tightening.

2. A mobile winch according to claim 1 wherein the drum carries at each of its ends a respective ratchet wheel, and a forked lever with means for engaging simultaneously the teeth of the two ratchets wheels is provided for rotating the drum.

3. A mobile winch according to claim 1 wherein a worm is rotatably mounted on the base in driving engagement with a gear wheel mounted on one end of the drum for rotating the drum.

4. A mobile winch according to claim 1 wherein the end of the drum remote from said second opening is formed to receive in positive engagement one end of a lever for rotating the drum.

5. A mobile winch according to claim 1 wherein the bar lies in a plane parallel with the bottom of the channel and tangential to the peripheral surface of the drum.

* * * * *